United States Patent [19]

Foust

[11] Patent Number: 4,557,405

[45] Date of Patent: Dec. 10, 1985

[54] REVERSIBLE CLOSURE-SPOUT ASSEMBLY

[75] Inventor: Ronald L. Foust, Delphos, Ohio

[73] Assignee: The Dyson-Kissner-Moran Corporation, New York, N.Y.

[21] Appl. No.: 485,348

[22] Filed: Apr. 15, 1983

[51] Int. Cl.[4] ..... B67D 3/00

[52] U.S. Cl. ..... 222/539; 222/542

[58] Field of Search ..... 222/539, 542, 538, 527, 222/464, 568, 570; 285/331

[56] References Cited

U.S. PATENT DOCUMENTS

| | | | |
|---|---|---|---|
| 301,575 | 7/1884 | Deverall | 222/539 X |
| 927617 | 7/1909 | Weber | 222/542 X |
| 2,757,831 | 8/1956 | Schmidt | 222/542 X |
| 2,822,960 | 2/1958 | Lengel | 222/464 X |
| 3,049,271 | 8/1962 | Whitmore | 222/542 X |
| 3,185,361 | 5/1965 | Gersten | 222/539 |
| 3,515,413 | 6/1970 | Beall | 285/331 X |
| 4,265,378 | 5/1981 | Bianco | 222/539 |
| 4,426,027 | 1/1984 | Maynard, Jr. | 222/539 |

FOREIGN PATENT DOCUMENTS

| | | | |
|---|---|---|---|
| 226143 | 12/1959 | Australia | 222/539 |
| 129868 | 10/1932 | Austria | 222/539 |

*Primary Examiner*—F. J. Bartuska
*Assistant Examiner*—Nils Pedersen
*Attorney, Agent, or Firm*—Biebel, French & Nauman

[57] ABSTRACT

A reversible closure-spout assembly which includes a flexible pour spout and a sealing member consisting of first and second spaced disks sealed to each other at their peripheries and defining a chamber therebetween, a series of slots formed through the first disk and communicating with the chamber, and a tube projecting from the second disk away from the chamber and communicating with the chamber. The tube is received and sealed within an end of the spout to make a leak-proof passage through the spout, tube, chamber, and slots. The spout assembly preferably includes a cap having a cylindrical side wall threaded to engage a threaded collar of a container and a top portion having a central hole to receive the spout therethrough and an annular gasket to form a seal alternately with the first or second disks.

3 Claims, 3 Drawing Figures

REVERSIBLE CLOSURE-SPOUT ASSEMBLY

BACKGROUND OF THE INVENTION

The present invention relates to a closure-spout assembly for liquid containers.

Containers for gasoline or other volatile or corrosive liquids typically include a threaded collar which defines an opening to the container and a closure-spout assembly which, in a storage configuration, provides a closure for the container and in a pouring configuration provides a pour spout. For example, in the Bianco U.S. Pat. No. 4,265,378, a reversible closure-spout assembly is disclosed which includes a threaded cap having a central opening, an annular gasket in the cap, and a flexible pour spout having a outwardly projecting flange at one end. Attached to the flange is a disk-shaped sealing member, a portion of which forms a seal with the threaded cap in a storage configuration, while in a pouring configuration, liquid can flow from the container through slots in the disk-shaped member and out through the spout.

A problem which may occur with a closure-spout assembly of this type arises from the fact that the flange and flexible spout are typically made of metal and interconnected by brazing or soldering. Occasionally, the solder or brazing compound does not form a complete seal between the flange and spout, leaving small openings or gaps therebetween. Also, due to the exigencies of manufacturing, the flange is not always attached to the spout such that it is flush with its end, but rather is spaced slightly away from the end of the spout such that the end of the spout forms a slightly raised lip or rim. This lip, together with the shape of the flange, forms an annular depression at the joint between the flange and spout.

Thus, when arranged in the pouring configuration, the fluid pressure on the annular slot may force the fluid to flow through the gaps left in the joint between the flange and tube, resulting in the fluid leaking from the container along the outside of the spout.

Accordingly, there is a need for a closure-spout assembly which is less likely to be formed with gaps which permit the fluid flowing through the spout to leak over the outer surface of the spout. There is also a need for a closure-spout assembly which is relatively inexpensive to manufacture and which does not require expensive materials. Such a closure-spout assembly should also be usable with presently existing containers such as gasoline cans.

SUMMARY OF THE INVENTION

The present invention provides a closure-spout assembly in which the likelihood of fluid leakage when in the pouring configuration is greatly reduced. Furthermore, the present invention may be used with existing fluid containers such as gasoline cans and the like. Another advantage of the invention is that the closure assembly may be used with existing caps and gaskets, thereby enabling retrofitting and changeover of parts. Another advantage of the invention is that the closure assembly is relatively inexpensive to manufacture.

The present invention is a reversible closure-spout assembly which consists of a flexible tubular spout, a first disk member having a first annular portion, a central opening through the annular portion, and a tube communicating with the central opening and mounted within an end of the spout, a second disk member having a second annular portion with slots therethrough and sealed to the first disk member at the outer peripheries thereof, and a plurality of bosses extending between the disk members to form a chamber therebetween which communicates with the tube and slots such that the slots, chamber, tube and spout form a fluid path.

The closure-spout assembly is used in combination with a cap having a top portion with a central hole therethrough sized to receive the spout, and an annular gasket positioned adjacent the top portion to abut the outer surface of the second disk member when the assembly is in its closure configuration, or the outer surface of the first disk member when the assembly is in a pouring configuration.

A principal advantage of the closure-spout assembly over prior art devices is that the flange-flexible spout connection is eliminated and replaced by the integrally formed tube and first annular portion, such that there is no seam between them which might provide gaps or holes for fluid leakage through the first disk member and along the outer surface of the spout.

The tube is slightly oversized to form an interference fit with the interior of the flexible spout and preferably is secured thereto with an adhesive such as a cyanoacrylate ester. To ensure an even better seal, the tube preferably includes an annular bead extending outwardly about an end thereof which abuts the interior wall of the spout. Thus, with the interference fit between the tube and spout, the use of an adhesive, and the raised bead, the likelihood of fluid leakage around the tube and out the outer surface of the spout is extremely small.

Another advantage of the present invention is that the connection between the spout and the remainder of the closure assembly is located within the spout, rather than about the periphery of a metal flange, as with previously known devices. Thus, for leakage to occur through the connection between the spout and the remainder of the spout assembly, the fluid flowing through the assembly must flow through the slots and into the chamber between the disk members, through the tube in the direction of the spout, then it must reverse direction and flow backwardly between the tube and inner wall of the spout. Thus, even should an opening exist between the outer surface of the tube and the inner surface of the spout, fluid flow along this path would be highly unlikely, further reducing the probability of leakage.

An additional advantage of the invention is that the closure-spout assembly may be sized to be used in combination with caps previously used with other types of closure assemblies, such as that disclosed in the Bianco U.S. Pat. No. 4,265,378, the disclosure of which is incorporated herein by reference. Of course, when used with such previously existing caps, the closure-spout assembly can be retrofitted to existing fluid containers.

Accordingly, it is an object of the present invention to provide a closure-spout assembly which substantially reduces the likelihood of fluid leakage when arranged in a pouring configuration; a closure-spout assembly which can be used with previously existing containers and caps; and which is relatively inexpensive and easy to fabricate and utilizes relatively inexpensive materials.

Other objects and advantages will become apparent from the following description, the accompanying drawings, and the appended claims.

DESCRIPTION OF THE PREFERRED EMBODIMENT

Figure 1:
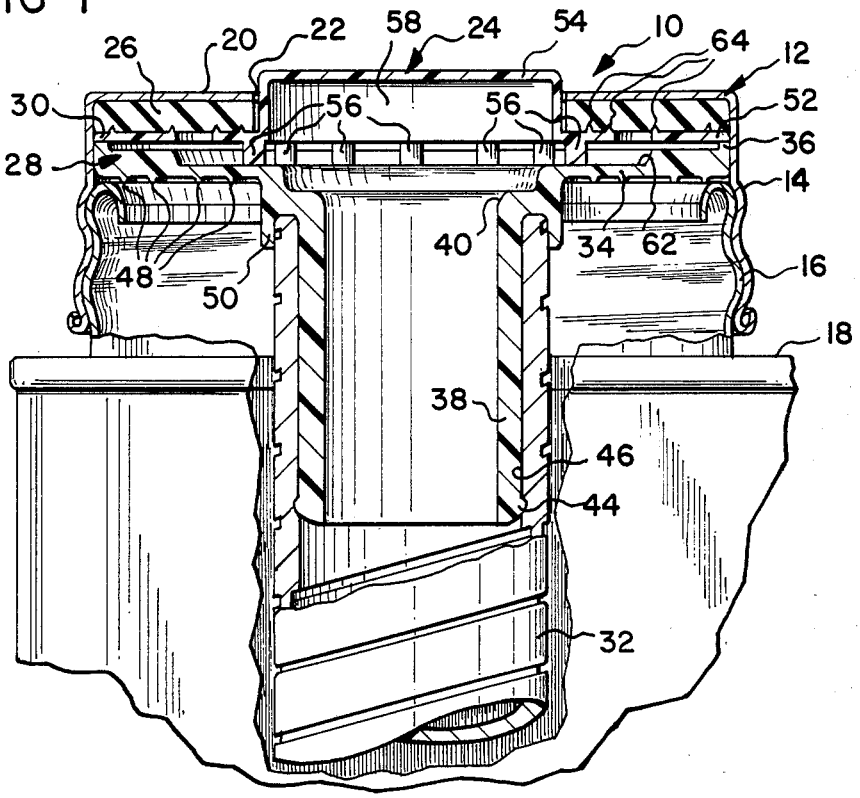
FIG. 1 is a side elevation in section of the reversible closure-spout assembly of the present invention fitted to the collar of a metal container in a closed configuration in which the collar is in section.

The reversible closure-spout assembly of the present invention, generally designated 10, includes a cap 12 having an annular side wall 14 shaped to provide threads which engage the threaded wall of a collar 16 of a container 18, such as a gasoline can. The cap 12 includes a disk-shaped end 20 having a central hole 22 through which the spout assembly 24 extends. An annular gasket 26, which may be made of cork or rubber, is seated within the cap 12 and provides a seal between the cap and the spout assembly 24. In this respect, the closure-spot assembly 10 of the present invention resembles the reversible closure-spout assembly disclosed in the Bianco U.S. Pat. No. 4,265,378, the disclosure of which is incorporated herein by reference.

Figure 2:
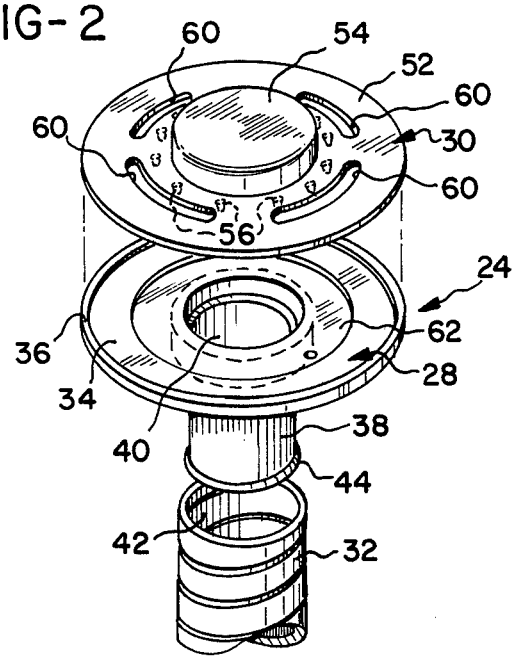
FIG. 2 is an exploded perspective view of the disk members of the spout assembly of FIG. 1.

As shown in FIGS. 1 and 2, the spout assembly 24 includes a first disk member 28, a second disk member 30 and a tubular spout 32. The spout 32 is made of a material commonly known as flex metal and is well-known in the art. The first disk member 28 includes a first annular portion 34 having a peripheral ridge 36 and a cylindrical tube 38, concentric with the first annular member and forming a central opening 40 therewith.

The tube 38 is sized to be inserted in the end 42 of the spout 32 and form an interference fit therewith. The tube 38 includes an annular bead 44 about its end which abuts the inner wall 46 of the spout 32 to ensure a complete seal. Preferably, the tube 38 is attached to the inner wall 46 of the spout 32 by an adhesive (not shown) to prevent the inadvertent separation of the tube and spout.

The underside of the first annular member 34 includes a plurality of concentric ridges 48 which, when brought into engagement with the gasket 26, provide a fluid-tight seal therewith. The underside of the first annular member 34 also includes an annular rib 50 concentric with the tube 38, and defining an annular slot 51 receiving and covering the end 42 of the spout 32. Thus, when the first annular member 34 is properly attached to the end 42 of the spout 32, the spout end is positioned between the annular rib 50 and tube 38.

The second disk member 30 of the spout assembly includes a second annular member 52 which is attached at its outer periphery to the peripheral ridge 36 of the first annular member 34 by sonic welding. Alternately, the first and second disk members could be formed as a single, integral part. The second annular member 52 includes a central cylindrical portion 54 extending outwardly therefrom and having a diameter which approximates that of the spout 32 and hole 22 in the cap 12.

Concentric with the cylindrical member 54, are a plurality of bosses 56, spaced substantially evenly about the cylindrical member. As best shown in FIG. 1, the bosses 56 extend outwardly from the plane of the second annular member 52 and abut the first annular member 34 in a circular pattern about the central opening 40, thus spacing the first and second disk members from each other. This space, together with the volume defined by the central cylindrical member 54, forms a chamber 58 between the first and second disk members 28,30.

Concentric with the cylindrical member 54 and bosses 56 are a plurallity of slots 60 formed in the second annular member 52. As shown in FIGS. 1 and 2, the first annular member 34 includes an annular recess 62 directly beneath the slots and extending inwardly to the central opening 40 of the first disk member 28. Thus, a fluid path is formed which extends from the slots 60, along the recess 62 and between the bosses 56 to the chamber 58, then through the central opening 40, tube 38, and then along the tubular spout 32 (see FIG. 3).

As shown in FIG. 1, the second annular member 52 also includes a plurality of annular concentric ridges 64, similar to the concentric ridges 48 formed on the first annular member 34, which form a fluid-tight seal when urged against the gasket 26.

As shown in FIG. 1, the closure-spout assembly 10 can be oriented in a fluid-tight, closed for storage configuration, thereby sealing the collar 16 of an associated container 18. In this configuration, the spout assembly 24 is positioned such that the central cylindrical member 54 is inserted through the hole 22 in the end 20 of the cap 12, and the ridges 64 of the second annular member 52 engage the gasket 26. The spout 32 is inserted through the collar 16 and into the container 18, and the cap 12 is threaded down onto the collar. The upper edge of the collar contacts the outer periphery of the underside of the first annular member, which causes the ridges 64 of the second annular member 52 to be urged upwardly against the gasket, as the gasket is clamped between the end 20 and second annular member 52.

In this configuration, the slots 60 are sealed by the gasket 26, thereby closing the previously described fluid pathway. It should be noted that the cylindrical member 54 can be dimensioned so that there is a slight gap between the outer surface of the member and the hole 22, since the fluid is stopped at the slots 60 by the gasket 26 and cannot progress to that gap. In addition, the gasket 26 is urged against the end 20 and side wall 14 to form a fluid-tight seal therewith. Fluid which might flow through the collar 16 and between the spout assembly 24 and cap would thus be prevented from flowing out through the gap between the end 20 and cylindrical member 54.

Figure 3:
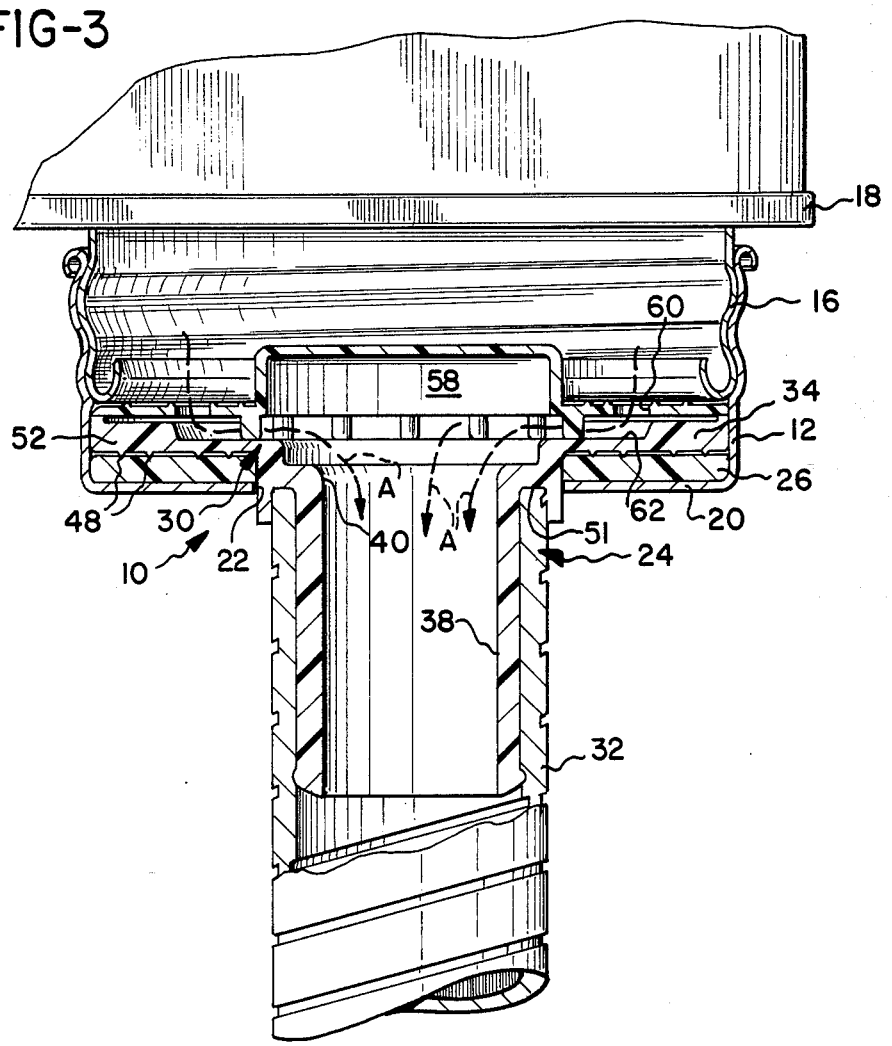
FIG. 3 is a side elevation in section showing the spout assembly of FIG. 1 attached to a collar of a container in a pouring configuration in which the collar and closure assembly are in section.

As shown in FIG. 3, the reversible closure-spout assembly 10 can be oriented to a pouring configuration by inverting the spout assembly 24 relative to the cap 12. In this configuration, the spout 32 is inserted through the hole 22 in the end 20 of the cap 12 so that the concentric ridges 48 of the underside of the first annular member 34 are brought into contact with the gasket 26. The cap 12 is then threaded down onto the collar 16 of the container 18 until the contact between the second annular member 52 and the upper edge of the collar 16 forces the ridges 48 of the first annular member 34 into the gasket 26, thereby providing a fluid-tight seal therewith. The gasket 26 also forms a seal with the cap 12 as previously described.

In this configuration, the previously described fluid pathway is open so that the fluid contents of the container 18 may follow the path of the broken arrows A and flow through the slots 60 and along the recess 62 to the chamber 58, where it then flows through the central opening 40, tube 38, and spout 32.

Since the tube 38 is formed integrally with the first annular member 34, there is little likelihood of fluid flowing in the direction of arrows A leaking through the connection between the second disk member 30 and spout 32. Furthermore, there is no point along the fluid path shown by the arrows A at which the fluid could collect and remain relatively stagnant during a pouring operation, giving rise for an opportunity for it to leak through a seam, as with prior art devices.

Although the spout assembly 24 can be made of a variety of materials, it is preferable to mold the first and second disk members 28,30 from a plastic such as polyethylene or the like, which is relatively rigid, wear resistant and corrosion resistant.

While the form of apparatus herein described constitutes a preferred embodiment of the invention, it is to be understood that the invention is not limited to this precise form of apparatus, and that changes may be made therein without departing from the scope of the invention.

What is claimed is:

1. In a reversible closure-spout assembly including a closure cap having a cylindrical side wall threaded for engagement with a complementarily threaded collar of a fluid container and a top portion having a central hole therethrough and a spout assembly having a tubular spout adapted to extend through said opening when said spout assembly is in a pouring cofiguration, the improvement comprising:

said spout assembly consisting of spaced apart molded plastic members integrally interconnected at their peripheries and defining a hollow plastic chamber and a molded plastic cylindrical tube formed integrally with said hollow plastic chamber, said integrally formed molded plastic tube having an outer diameter substantially less than the diameter of said central hole through said closure cap, said molded plastic tube being received in an interference fit within said tubular spout and thereby defining a fluid-tight connection between said tubular spout and said spout assembly consisting of said hollow plastic chamber and said integrally formed molded plastic tube, and a molded plastic annular rib formed integrally with said hollow plastic chamber and projecting concentrically with said plastic tube molded integrally therewith and receiving said tubular spout.

2. The assembly of claim 1 wherein the outer diamter of said spout is substantially less than said diameter of said central hole, and the outer diameter of said molded plastic annular rib is approximately equal to said diameter of said central hole.

3. In a reversible closure-spout assembly including a closure cap having a cylindrical side wall threaded for engagement with a complementarily threaded collar of a fluid container and a top portion having a central hole therethrough and a spout assembly having a tubular spout adapted to extend through said opening when said spout assembly is in a pouring configuration, the improvement comprising:

said spout assembly consisting of spaced apart molded plastic members integrally interconnected at their peripheries and defining a hollow plastic chamber and a molded plastic cylindrical tube formed integrally with said hollow plastic chamber, said integrally formed molded plastic tube having an outer diameter substantially less than the diameter of said central hole through said closure cap, said molded plastic tube being received in an interference fit within said tubular spout and thereby defining a fluid-tight connection between said tubular spout and said spout assembly consisting of said hollow plastic chamber and said integrally formed molded plastic tube, a molded plastic annular rib formed integrally with said hollow plastic chamber and projecting concentrically with said plastic tube molded integrally therewith and receiving said tubular spout, the outer diameter of said spout being substantially less than said diameter of said central hole, and the outer diameter of said molded plastic annular rib being approximately equal to said diameter of said central hole, an annular bead formed integrally with said molded plastic tube and engaging an interior surface of said tubular spout, and said closure cap being provided with an annular gasket seated therein concentric with said central hole, said hollow plastic chamber having opposite exterior surfaces adapted to engage alternately said gasket in storage and pouring configurations, respectively, and annular concentric ridges formed integrally with said exterior surfaces for alternate engagement with said gasket.

* * * * *